US008568161B1

(12) United States Patent
Lee et al.

(10) Patent No.: US 8,568,161 B1
(45) Date of Patent: Oct. 29, 2013

(54) ELECTRICAL CONNECTOR ASSEMBLY

(75) Inventors: Kuo-Chi Lee, Taipei County (TW); Chin-Huang Lin, Taipei County (TW)

(73) Assignee: Concraft Holding Co., Ltd., Grand Cayman (KY)

( * ) Notice: Subject to any disclaimer, the term of this patent is extended or adjusted under 35 U.S.C. 154(b) by 0 days.

(21) Appl. No.: 13/486,250

(22) Filed: Jun. 1, 2012

(51) Int. Cl.
*H01R 13/66* (2006.01)

(52) U.S. Cl.
USPC ..... 439/541.5

(58) Field of Classification Search
USPC ..... 439/541.5, 540.1
See application file for complete search history.

(56) References Cited

U.S. PATENT DOCUMENTS 8,210,880 B2 * 7/2012 Lee et al. ..... 439/639
2005/0255745 A1 * 11/2005 Walker et al. ..... 439/541.5
2007/0232131 A1 * 10/2007 Ju ..... 439/541.5
2007/0243757 A1 * 10/2007 Wan et al. ..... 439/541.5
2010/0035465 A1 * 2/2010 Wang ..... 439/541.5
2010/0093208 A1 * 4/2010 Hamner et al. ..... 439/541.5
2011/0014817 A1 * 1/2011 Lee et al. ..... 439/638
2012/0225585 A1 * 9/2012 Lee et al. ..... 439/626

* cited by examiner

*Primary Examiner* — James Harvey
(74) *Attorney, Agent, or Firm* — Muncy, Geissler, Olds & Lowe, PLLC

(57) ABSTRACT

An electrical connector assembly includes first and second connectors and an adapter module having an assembler member for assembling the first and second connectors together. The first connector has a terminal confining plate for confining the terminals therethrough. Each terminal has a contact section, a distributing section and an intermediate section interconnecting the contact and distributing sections. The adapter module further includes a one-piece terminal fixing member disposed within the assembler member for coupling to the terminal confining plate. The terminal fixing member is formed with first and second rows of terminal holes spaced apart in parallel manner, wherein the intermediate sections of the terminals are embedded within the first and second rows of terminal holes via insert molding process such that the contact and distributing sections of the terminals extend outward from two opposite sides of the terminal fixing member.

3 Claims, 7 Drawing Sheets

ELECTRICAL CONNECTOR ASSEMBLY

BACKGROUND OF THE INVENTION

1. Field of the Invention

The present invention relates to an electrical connector assembly, more particularly to an electrical connector assembly having a plurality of rows of terminals.

2. Description of the Prior Art

Since the transmission speed of the electrical connectors becomes faster as days gone by, the terminals of an electrical connector for insertion into the mother board must be spaced apart or staggered to one another at predetermined gap so as to prevent electromagnetic interference among the terminals. The manufacturers must produce new electrical connector having terminals with different specifications to conform to the soldering points on the new mother board, thereby adversely incurring undesired expense. It is urgently needed to solve the above-stated problem.

FIG. 1 shows a partly exploded view of a conventional electrical connector. The electrical connector 1000 includes an insulated body 110 and first, second and third rows of terminals 120, 130, and 140. In order for the terminals to be staggered relative to one another, the conventional electrical connector is provided with at least two rows of terminals 120, 130 of two different specifications, as best shown in FIG. 1, thereby resulting in extra expense for opening new mold.

In addition, the terminals 120, 130, 140 respectively have bifurcated structures, which are used for fixing on the insulated body 110. Thus, the terminals 120, 130, 140 are fabricated by punching out several long, flat metal plates so as to obtain the bifurcated structures. A large waste of metal pieces is remained after the punching operation, and causes environmental pollution.

Several electrical connectors of different dimensions and specifications are invented ceaselessly. Some newly produced electronic apparatuses require the most advanced electrical connector for market competition. At the same time, the conventional electrical connectors still in use must satisfy the general users of the electronic apparatuses.

For instance, it usually requires more than five electrical connectors for connecting the peripheral devices to the display screen and the mother board of a computer set. Four to five USB (Universal Serial Bus) devices and HDMI (High Definition Multimedia Interface), the most common ones, may be implemented in a computer set so that the electrical connectors of different types are generally stacked one above the other when in use.

In addition, since new mother boards are developed quickly day by day, the electrical connectors for application with the new mother boards differed from one another. Therefore, an electrical connector assembly of a specific type cannot get along with the newly produced mother board. As a result, the manufacturers must design a new mold for developing a new electrical connector, thereby increasing the undesired production cost.

Referring to FIGS. 1A and 1B, wherein FIG. 1A shows a perspective view of a conventional electrical connector assembly 1000*a* while FIG. 1B is an exploded view of the conventional electrical connector assembly 1000*a* shown in FIG. 1A. The conventional electrical connector assembly 1000*a* includes a first connector 110*a*, a second connector 120*a*, an assembler member 130*a* and a fixing member 140*a*.

The assembler member 130*a* couples the first and second connectors 110*a*, 120*a* together. The first connector 110*a* has a first row of terminals 111*a*. The first terminals 111*a* have soldering sections 1111*a* arranged in two array manner and spaced from one another at a preset distance by the fixing member 140*a* such that the first terminals 111*a* extend through the assembler member 130*a* and the fixing member 140*a*. The second connector 120*a* has a second row of terminals 121*a*. The second terminals 121*a* have soldering sections 1211*a* arranged in two array manner and spaced from one another at a preset distance by the fixing member 140*a*.

Note that in the aforesaid conventional electrical connector assembly 1000*a*, the first and second connectors are coupled by the assembler member 130*a* together one stacking over the other. However each connector requires terminals of a specific type so that several specific types of terminals are needed in order to maintain the soldering sections 1111*a*, 1211*a* in two array manner over two tongue plates 112*a*, 122*a* thereof, thereby causing inconvenience during the assembly of the conventional electrical connector assembly. Moreover, since the soldering sections in the terminals are required to design to complement with the different position of soldering spots on the mother board, an extra manufacture cost is resulted. In addition, fabrication of the terminals in the first and second connectors can be conducted only after determining relative to the soldering spots on the mother board, there may occur late delivery of the electrical connector assemblies and suffer loss of market competition.

SUMMARY OF THE INVENTION

Therefore, the object of the present invention is to provide an electrical connector assembly, which includes an adapter module for coupling first and second connectors in order to form the electrical connector assembly. Moreover, since the terminals of a single specification is utilized in the electrical connector assembly of the present invention, the problems of manufacturing terminals of several specifications and the loss caused due to non-alignment of the terminals during the insertion process can be avoided.

In another aspect of the present invention, the electrical connector assembly accordingly includes a first connector, a second connector and an adapter module having an assembler member for assembling the first and second connectors together in order to form the electrical connector assembly. The first connector has a terminal confining plate for confining plurality of terminals therethrough. Each of the terminals has a contact section, a distributing section and an intermediate section interconnecting the contact and distributing sections. The adapter module further includes a one-piece terminal fixing member disposed within the assembler member for coupling to the terminal confining plate. The terminal fixing member is formed with first and second rows of terminal holes spaced apart from each other in a parallel manner, wherein the intermediate sections of the terminals are embedded within the first and second rows of terminal holes in the terminal fixing member via insert molding process such that the contact and distributing sections of the terminals extend outward from two opposite sides of the terminal fixing member.

During the assembly process of the electrical connector assembly of the present invention, insertion of the contact sections of the terminals into the first connector is facilitated owing to uniform alignment of the contact sections of the terminals and after which an assembly of the first connector and the terminal fixing member is coupled to the assembler member from an upper side, thereby forming an upper plug chamber for mating with a first foreigner connector. The second connector is coupled to the assembler member from a lower side thereof such that the terminals extend through the second connector, thereby forming a lower plug chamber exposing two rows of the distributing sections of the terminals from the second connector for mating with a second foreigner connector.

As described above, the terminals of a single specification is utilized for the first and second connectors, thereby economizing the manufacturing cost of the electrical connector assembly of the present invention. In addition, only a single insert operation is required during insertion of the contact sections of the terminals into the first connector owing to embedded intermediate sections of the terminals within the terminal fixing member via the insert molding process, where the distributing sections of the terminals are exposed from the second connector in two in parallel rows, thereby economizing the assembling and fabrication time. In other words, metal waste is minimized since the terminals of a single specification are employed.

By simple variation in the structure of the adapter module, pieces of independently located connectors, such as the first and second connectors, can be coupled electrically to the adapter module so as to result in different electrical connector assembly. Note that first and second connectors can be independently operated and do not require any alteration due to possessing the same terminal structure but are designed in different ways. By just simply arranging the rows of terminal holes in the-terminal fixing member, the distributing sections of the terminals are arranged to be compatible with the soldering spots in the different mother boards. Thus, the manufacturers only need to produce the connectors of different specifications. After assuring the specification of the mother board, the distributing sections of the terminals in the first and second connectors are arranged in such a manner to complement with the soldering spots of the desired mother board.

BRIEF DESCRIPTION OF THE DRAWINGS

Other features and advantages of this invention will become more apparent in the following detailed description of the preferred embodiments of this invention, with reference to the accompanying drawings, in which.

DETAILED DESCRIPTION OF THE PREFERRED EMBODIMENTS

Figure 1:
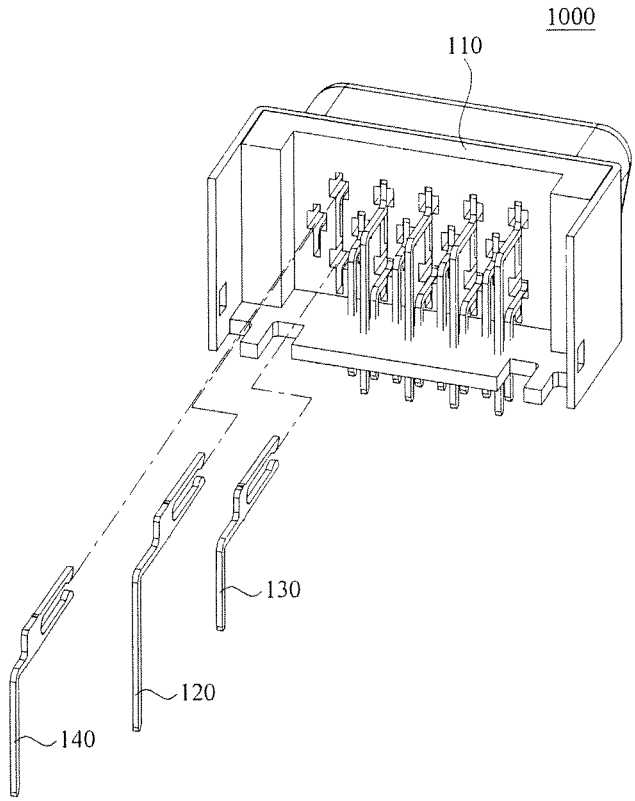
FIG.1(Prior Art)
FIG. 1 shows a partly exploded view of a prior art electrical connector assembly.
Figure 1A:
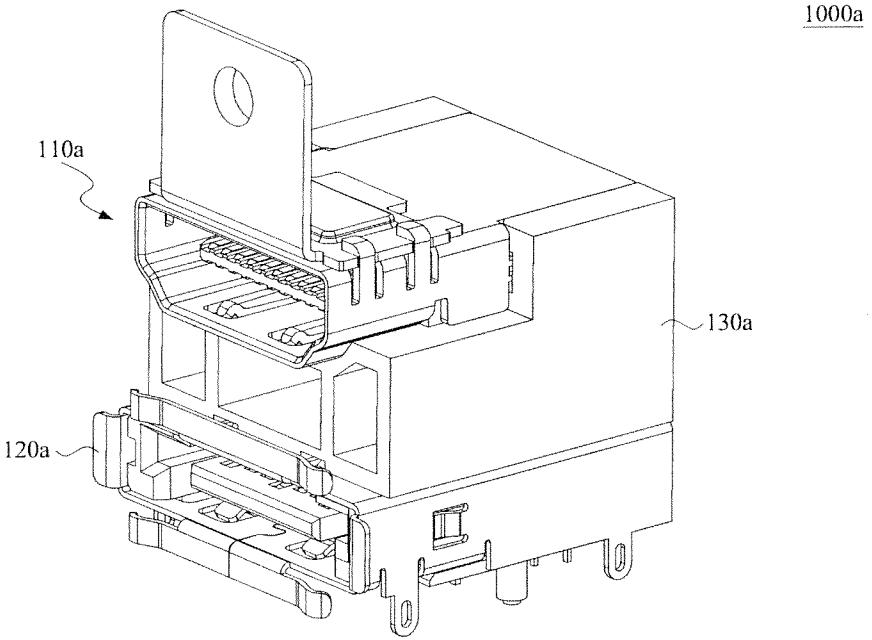
FIG.1A(Prior Art)
FIG. 1A shows a perspective view of another conventional electrical connector assembly.
Figure 1B:
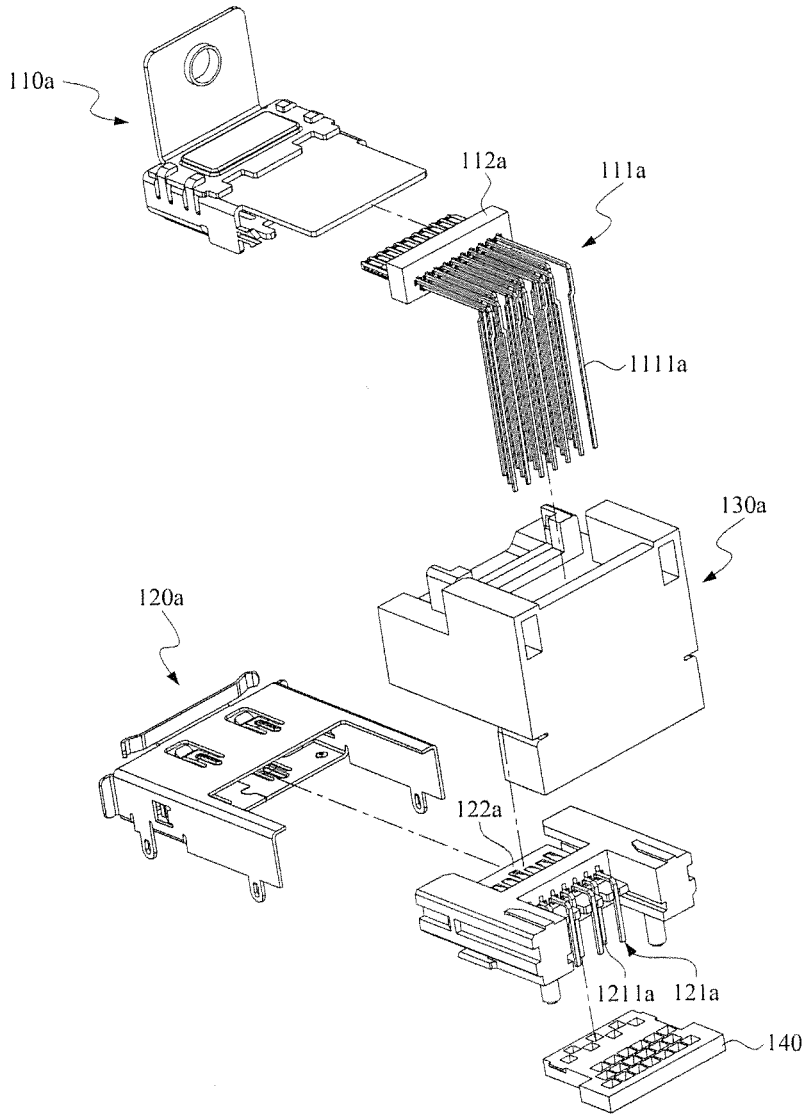
FIG.1B(Prior Art)
FIG. 1B is an exploded view of the another conventional electrical connector assembly shown in FIG. 1A.
Figure 2:
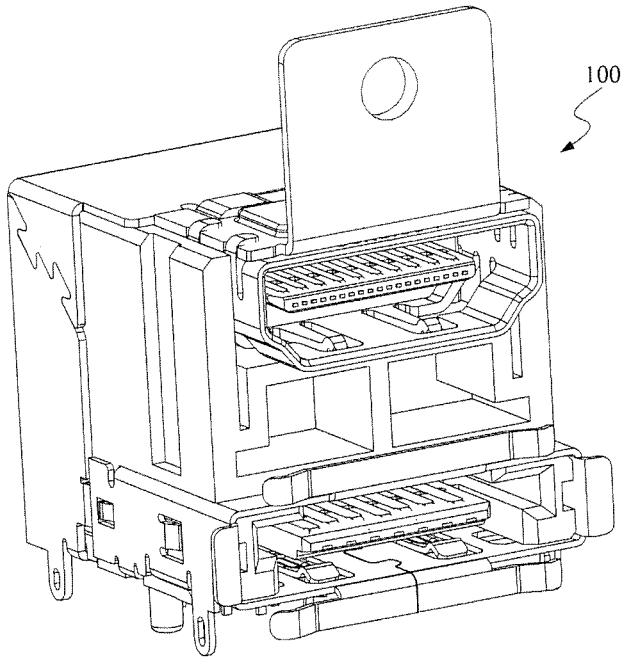
FIG. 2 is a perspective view of an electrical connector assembly of the present invention.
Figure 2A:
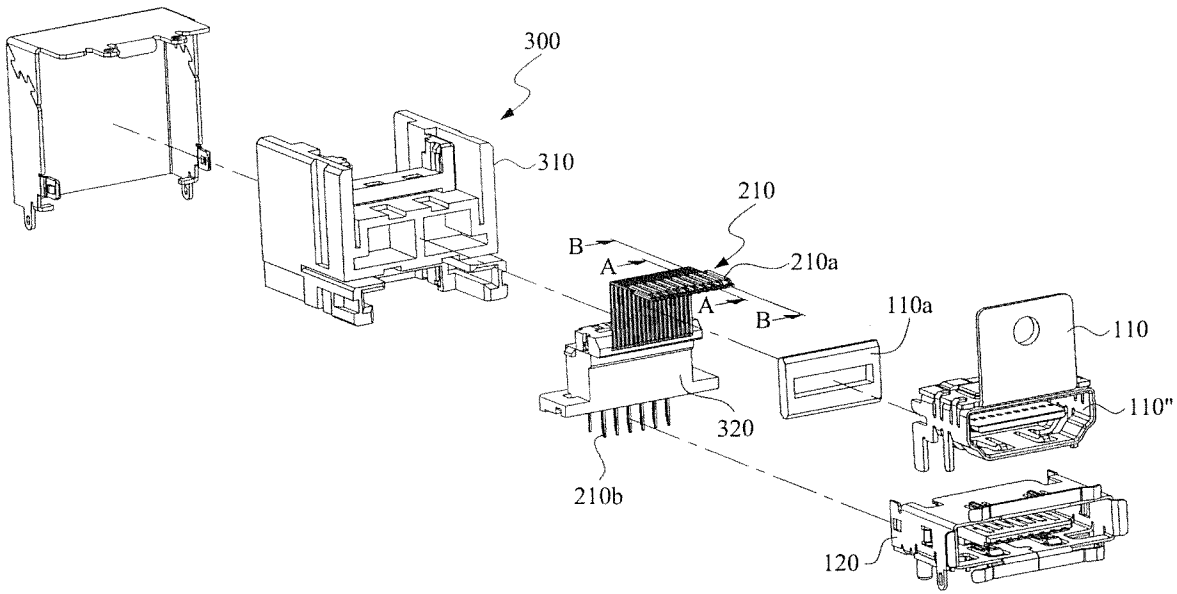
FIG. 2A is an exploded view of the electrical connector assembly of the present invention.

Referring to FIGS. 2 and 2A, wherein FIG. 2 is a perspective view of an electrical connector assembly of the present invention while FIG. 2A is an exploded view of the electrical connector assembly of the present invention. As illustrated, the electrical connector assembly 100 of the present invention includes a first connector 110, a second connector 120 and an adapter module 300.

The first connector 110 includes a first connector body 110", a terminal confining plate 110*a* disposed securely within the first connector body 110" for confining plurality of terminals 210 therethrough. Each of the terminals 210 has a contact section 210*a*, a distributing section 210*b* and an intermediate section 210*c* interconnecting the contact and distributing sections 210*a*, 210*b*.

The adapter module 300 includes an assembler member 310 and a one-piece terminal fixing member 320. The assembler member 310 is used for assembling the first and second connectors 110, 120 together in order to form the electrical connector assembly 100 of the present invention. The one-piece terminal fixing member 320 is disposed within the assembler member 310 and is coupled to the terminal confining plate 110*a* installed within the first connector 110. In this embodiment, the terminal fixing member 320 is formed with first and second rows of terminal holes 320*a*, 320*b* spaced apart from each other in a parallel manner, wherein the intermediate sections 210*c* of the terminals 210 are embedded within the first and second rows of terminal holes 320*a*, 320*b* via insert molding process such that the contact and distributing sections of the terminals 210 extend outward from two opposite sides of the terminal fixing member 320 prior to installing the fixing member 320 within the assembler member 310.

During assembly so as to form the electrical connector assembly of the present invention, insertion of the contact sections 210*a* of the terminals 210 into the first connector 110 (i.e., through the terminal confining plate 110*a*) is facilitated owing to uniform alignment of the contact sections 210*a* of the terminals 210 and after which an assembly of the first connector 110 and the terminal fixing member 320 is coupled to the assembler member 310 from an upper side, thereby forming an upper plug chamber for mating with a first foreigner connector (not shown). Afterwards the second connector 120 is coupled to the assembler member 310 from a lower side thereof such that the terminals 210 extend through the second connector 120, thereby forming a lower plug chamber for exposing two rows of the distributing sections 210*b* of the terminals 210 from the second connector 120 for mating with a second foreigner connector (not shown).

It is important to note that during the assembly, because the contact sections 210*a* of the terminals 210 are maintained in alignment relative to one another due to embedded intermediate sections 210*c* within the terminal fixing member 320 via the insert molding process, a single insert action is required to be conducted in order to install the contact sections 210*a* of the terminals 210 within the first connector body 110".

Figure 2B:
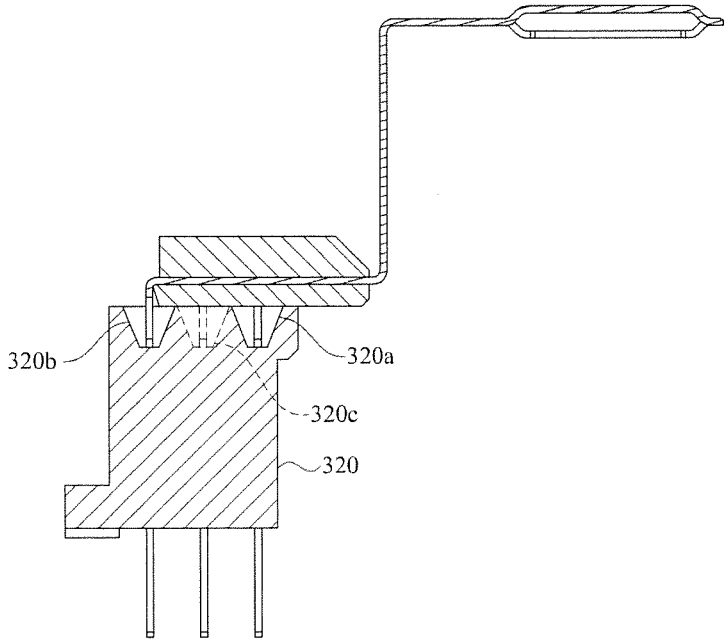
FIG. 2B is a cross sectional view of a terminal fixing member employed in the electrical connector assembly of the present invention taken along the line A-A in FIG. 2A.

In this embodiment, the two parallel rows of the distributing sections 210*b* of the terminals 210 are located at two opposite sides of a longitudinal length of the terminal fixing member 320, as best shown in FIG. 2B, wherein FIG. 2B is a cross sectional view of the terminal fixing member 320 employed in the electrical connector assembly 100 of the present invention taken along the line A-A in FIG. 2A.

Figure 2C:
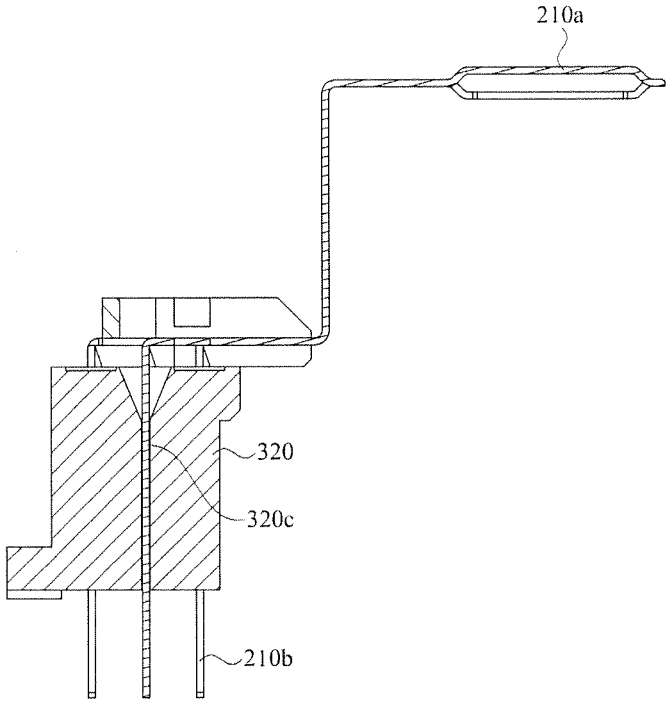
FIG. 2C is another cross sectional view of the terminal fixing member employed in the electrical connector assembly of the present invention taken along the line B-B in FIG. 2A.

Preferably, the fixing member 320 is further formed a third row of terminal holes 320*c* sandwiched between the first and second rows of terminal holes 320*a*, 320*b* and the third row extends along the longitudinal length of the terminal fixing member 320. Under this condition, after assembly of the electrical connector assembly 100 of the present invention, three rows of the distributing sections 210*b* of the terminals 210 are exposed from the second connector 120, as best shown in FIG. 2C, wherein FIG. 2C is another cross sectional view of the terminal fixing member employed in the electrical connector assembly of the present invention taken along the line B-B in FIG. 2A. Since the purpose of the distributing sections 210*b* of the terminals 210 are the same as the previous embodiment, a detailed description thereof is omitted herein for the sake of brevity.

As described above, in each embodiment of the electrical connector assembly of the present invention, only a single insert operation of the terminals of a single specification is required during the assembling process, where the distributing sections of the terminals are arranged in parallel rows, thereby economizing the assembling and fabrication time. In other words, metal waste is minimized since the terminals are formed by bending the flat, long metal plate due to lesser presence of bifurcated structure in the terminals.

By utilizing simple variation in the adapter module, two pieces of independently located first and second connectors 110, 120 can be coupled electrically to the adapter module so as to result in different electrical connector assembly. Note that the first and second connectors 110, 120 can be independently operated provided with the same terminals 210 and do not require any alteration due to possessing the same terminal structure but are designed in different ways. In other words, the first and second connectors 110, 120 can be independently operated provided with the terminals of another specification different from the present ones. By just simply arranging the rows of terminal holes in the terminal fixing member 320, the distributing sections of the terminals are arranged to be compatible with the soldering spots in the different mother boards. Thus, the manufacturers only need to produce the connectors of different specifications. After assuring the specification of the mother board, the distributing sections of the terminals in the first and second connectors are arranged in such a manner to complement with the soldering spots of the desired mother board.

While the invention has been described in connection with what is considered the most practical and preferred embodiments, it is understood that this invention is not limited to the disclosed embodiments but is intended to cover various arrangements included within the spirit and scope of the broadest interpretation so as to encompass all such modifications and equivalent arrangements.

What is claimed is:

1. An electrical connector assembly comprising:

a first connector including a terminal confining plate for confining plurality of terminals therethrough, each of said terminals having a contact section, a distributing section and an intermediate section interconnecting said contact and distributing sections;

a second connector; and an adapter module including an assembler member for assembling said first and second connectors together in order to form the electrical connector assembly, and a one-piece terminal fixing member for disposing within said assembler member and for coupling to said terminal confining plate installed within said first connector, said fixing member having first and second rows of terminal holes spaced apart from each other in a parallel manner, wherein said intermediate sections of said terminals are embedded within said first and second rows of terminal holes via insert molding process such that said contact and distributing sections of said terminals extend outward from two opposite sides of said terminal fixing member;

wherein, during assembly insertion of said contact sections of said terminals into said first connector is facilitated owing to uniform alignment of said contact sections of said terminals and after which an assembly of said first connector and said terminal fixing member is coupled to said assembler member from an upper side, thereby forming an upper plug chamber for mating with a first foreigner connector while said second connector is coupled to said assembler member from a lower side thereof such that said terminals extend through said second connector, thereby forming a lower plug chamber for exposing two rows of said distributing sections of said terminals from said second connector for mating with a second foreigner connector.

2. The electrical connector assembly according to claim 1, wherein said two parallel rows of said distributing sections of said terminals are located at two opposite sides of a longitudinal length of said terminal fixing member.

3. The electrical connector assembly according to claim 2, wherein said fixing member is further formed a third row of terminal holes sandwiched between said first and second rows of terminal holes and extending along said longitudinal length of said terminal fixing member.

* * * * *